US007845874B2

(12) United States Patent
Crosnier et al.

(10) Patent No.: US 7,845,874 B2
(45) Date of Patent: Dec. 7, 2010

(54) PACKAGING AND DISPENSER DEVICE

(75) Inventors: Daniel Crosnier, Offranville (FR); Christiane Léonice Léone Boyer, legal representative, Offranville (FR); Marc Ramet, Asnieres sur Seine (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 1157 days.

(21) Appl. No.: 11/491,163

(22) Filed: Jul. 24, 2006

(65) Prior Publication Data

US 2007/0025799 A1 Feb. 1, 2007

Related U.S. Application Data

(60) Provisional application No. 60/707,985, filed on Aug. 15, 2005.

(30) Foreign Application Priority Data

Jul. 26, 2005 (FR) ..... 05 52317

(51) Int. Cl.
*B43K 5/06* (2006.01)

(52) U.S. Cl. ..... 401/175; 401/172

(58) Field of Classification Search ..... 401/172, 401/173, 174, 175, 68, 75, 116; 222/390
See application file for complete search history.

(56) References Cited

U.S. PATENT DOCUMENTS

| | | | | |
|---|---|---|---|---|
| 4,336,728 | A * | 6/1982 | Deibert | 81/62 |
| 4,865,231 | A * | 9/1989 | Wiercinski | 222/390 |
| 5,725,133 | A * | 3/1998 | Iaia | 222/390 |
| 5,839,622 | A * | 11/1998 | Bicknell et al. | 222/390 |
| 6,592,278 | B1 | 7/2003 | Holthaus | |

FOREIGN PATENT DOCUMENTS

| | | |
|---|---|---|
| DE | 297 15 402 U1 | 2/1999 |
| DE | 201 21 463 UI | 10/2002 |
| EP | 1 405 803 A1 | 4/2004 |
| WO | WO 00/64303 A1 | 11/2000 |

* cited by examiner

*Primary Examiner*—David J Walczak
(74) *Attorney, Agent, or Firm*—Oliff & Berridge, PLC

(57) ABSTRACT

A packaging and dispenser device for a composition may include: a casing containing a reserve of composition; a composition-dispenser mechanism including a rotary member, which, when turned in a first direction, is accompanied by the composition being dispensed; and an actuator system configured to turn on the rotary member of the composition dispenser mechanism. The actuator system may include: a first pushbutton configured to turn the rotary member in the first direction; and a second pushbutton configured to turn the rotary member in a second direction, opposite to the first direction. The rotary member being turned in the first direction may be independent of the rotary member being turned in the second direction.

41 Claims, 5 Drawing Sheets

PACKAGING AND DISPENSER DEVICE

This non-provisional application claims the benefit of French Application No. 05 52317 filed on Jul. 26, 2005 and U.S. Provisional Application No. 60/707,985 filed on Aug. 15, 2005, the entire disclosures of which are incorporated herein by reference.

The present invention relates to packaging and dispenser devices for a composition. More, particularly, the invention relates to such devices comprising: a casing containing a reserve of composition; a composition-dispenser mechanism comprising a rotary member; and an actuator system that makes it possible to act on the rotary member of the dispenser mechanism in such a manner that turning the rotary member in a first direction causes the composition to be dispensed.

BACKGROUND

In such devices, the rotary member is typically secured to a screw, for example, that drives a piston that is capable of sliding in the casing.

International application WO 00/64303 discloses a deodorant dispenser that includes two diametrically-opposite pushbuttons on which a user may press so as to turn the rotary member always in the same direction to dispense the composition.

European patent application EP 1 405 803 and German utility model DE 297 15 402 describe devices that include a single pushbutton only, with pressure on the pushbutton being accompanied by the rotary member turning in the direction that results in the composition being dispensed. The actuator system may be configured in such a manner as to turn the rotary member in a second direction, opposite to the first direction, while the pushbutton is returning to an initial position thereof, the second turning movement being of an amplitude that is smaller than an amplitude of the first turning movement.

SUMMARY

There exists a need to further improve packaging and dispenser devices that include an actuator system that is configured to act on the rotary member of a dispenser mechanism.

Exemplary embodiments of the invention may provide a packaging and dispenser device for a composition. The device may comprise: a casing containing a reserve of composition; a composition-dispenser mechanism comprising a rotary member, which, when turned in a first direction, is accompanied by the composition being dispensed; and an actuator system that makes it possible to act on the rotary member of the dispenser mechanism. The actuator system may comprise: a first pushbutton that makes it possible to turn the rotary member in the first direction; and a second pushbutton that makes it possible to turn the rotary member in a second direction, opposite to the first direction; with the rotary member being turned in the first direction independently of the rotary member being turned in the second direction.

The term "pushbutton" should not be understood restrictively, and encompasses any bearing surface on which a user may exert an action to cause the rotary member to be displaced. The pushbuttons may comprise a single part or a plurality of distinct parts.

By exemplary embodiments of the invention, the user may dispense composition by pressing on the first pushbutton as many times as desired, depending on a quantity to be dispensed, and may also press on the second pushbutton to retract an amount of unused composition into the casing.

A force exerted on each pushbutton may be relatively small, thereby contributing to comfort in use, even in the event of significant friction involving moving parts of the device or the composition in the casing. This may also enable metering to be accurate.

In exemplary embodiments, at least part of the first and second pushbuttons may be made integrally, i.e., monolithically, with a base portion of the actuator system. The actuator system may thus be easier to construct, and may be more reliable in operation.

The base portion may be mounted in a stationary manner on the casing, or, in exemplary embodiments, may be hinged on the casing. The term "mounted in a stationary manner" means that at least a portion of the base portion does not move perceptibly relative to the casing.

For example, when the base portion is mounted in stationary manner on the casing, the base portion may advantageously include two elastically-deformable blades, each associated with a respective one of the pushbuttons. Each blade may flex when the user presses on the corresponding pushbutton, and each blade may make it possible to return the pushbutton to an initial position thereof when the pushbutton is released by the user.

The base portion may include arms, each configured to act on the rotary member when the user presses on the corresponding pushbutton. Each arm may include at least a first portion in relief that may be configured to co-operate with a second portion in relief of the rotary member when the user presses on the pushbutton, so as to turn the rotary member.

The first portion in relief may advantageously be configured to mesh with the rotary member during a relative movement corresponding to the pushbutton being pressed, and to disengage from the rotary member during a relative movement in an opposite direction. Thus, each time the pushbutton is pressed, the arm may turn the rotary member in the corresponding direction, and when the user releases the pushbutton, the rotary member may not be driven in the opposite direction by a return movement of the arm.

Each arm may be carried by a blade.

For example, the rotary member may include fluting.

The two arms may slope toward each other, thereby enabling the arms to come into contact more easily with the rotary member, substantially tangentially thereto, for example, to turn the rotary member.

The two arms that are respectively associated with two pushbuttons may be substantially symmetrical to each other about a mid-plane of the device. In exemplary embodiments, the actuator system may include a brake that tends to prevent the rotary member from moving during return movements of the arms.

For example, the brake may comprise a brake shoe that comes into contact with the rotary member. The brake shoe may advantageously be made integrally, i.e., monolithically, with the base portion of the actuator system.

The brake shoe may include a thin zone that imparts a certain flexibility thereto, so as not to prevent the rotary member from turning.

The brake shoe may include a ridge that is disposed in such a manner as to become engaged in a groove of the fluting of the rotary member. Each time the ridge passes from one groove to another, a click sound may be emitted.

The brake shoe may be disposed between two splines of the casing, which may, for example, limit an angular movement of the brake shoe while the rotary member is turning.

At least one of the base portion and the casing may include a slideway, and the other one of the base portion and the casing may include a corresponding portion in relief engaged in the slideway. The base portion may thus be fastened in a simple manner onto the casing, for example, by sliding along a longitudinal axis of the casing, and the manufacture of the device may thus be further simplified.

For example, the casing may include two openings that make it possible to access the pushbuttons, and the pushbuttons may project outward at rest, so as to make it easier for the user to actuate the pushbuttons.

In exemplary embodiments, the resilient blades of the base portion may be pressed against edges of the openings when the device is at rest, thereby preventing dirt from penetrating inside the casing, for example.

In exemplary embodiments, the pushbuttons of the actuator system may be hinged about a common pivot axis.

For example, the casing may include a separate part including a pivot pin on which the base portion is hinged. The separate part may include a brake surface that comes into contact with the rotary member, the brake surface possibly including at least one portion in relief for increasing friction.

The brake surface may come to bear axially against an end face of the rotary member.

The device may include a resilient return member that urges the rotary member to bear against the brake surface. For example, the resilient return member may comprise elastically-deformable fins that are molded integrally, i.e., monolithically, with the rotary member, and that may bear axially against a transverse wall of the casing. The transverse wall may also serve to guide a screw that is secured to the rotary member.

The rotary member may include two sets of teeth that are axially-offset, and that include oppositely-directed catches.

The actuator system may be configured to act on a respective one of the two sets of teeth when the user pivots the actuator system in one direction and in the other direction. For example, the actuator system may include two arms that are configured to act on respective ones of the sets of teeth. Each arm may include a shape that enables the arm to come into contact with an associated one of the sets of teeth, when the corresponding pushbutton is actuated. The two arms may advantageously be made integrally, i.e., monolithically, with the base portion.

The base portion may include abutments that make it possible to limit the degree to which the base portion pivots in one direction or in the other direction by coming into abutment against a wall of the casing. The casing may include an opening that enables the user to access the pushbuttons.

The base portion may include indicators, such as printing or molded portions in relief, for example, that inform the user about locations of the bearing zones constituting the pushbuttons, and about directions in which the piston or the dish may be displaced inside the casing.

Regardless of how the actuator system is made, the actuator system may advantageously be configured in such a manner that pressing on one of the pushbuttons enables the rotary member to pivot through a stroke that is substantially identical to a pivot stroke that results from pressing on the other pushbutton, when pressed a same degree.

The rotary member may be secured to a screw, as mentioned above, and the screw may mesh with a piston or a dish, for example, the piston or the dish being movable in translation inside the body of the casing, for example, in a cylindrical portion of the casing, for example, of a non-circular inside section.

The casing may contain a solid cake of composition, for example, that is carried by the dish.

The casing may, alternatively or additionally, contain a fluid, for example, a gel, a paste, or a cream, contained in an inside space of the casing. The composition may be dispensed, for example, through a dispenser endpiece or a dome provided with at least one dispenser orifice. The casing may include a piston that meshes with the screw, for example, and that makes it possible to force the composition through the dispenser orifice(s).

Exemplary embodiments of the invention may apply to dispensing and packaging various compositions, for example, cosmetics, and skin or other care products.

A cosmetic may be for application to the skin, for example, such as a deodorant, makeup, or a skin care product, for example, a foundation.

BRIEF DESCRIPTION OF THE DRAWINGS

Various details of the present invention may be better understood on reading the following detailed description of non-limiting embodiments, and on examining the accompanying drawings, in which.

DETAILED DESCRIPTION OF EMBODIMENTS

Figure 1:
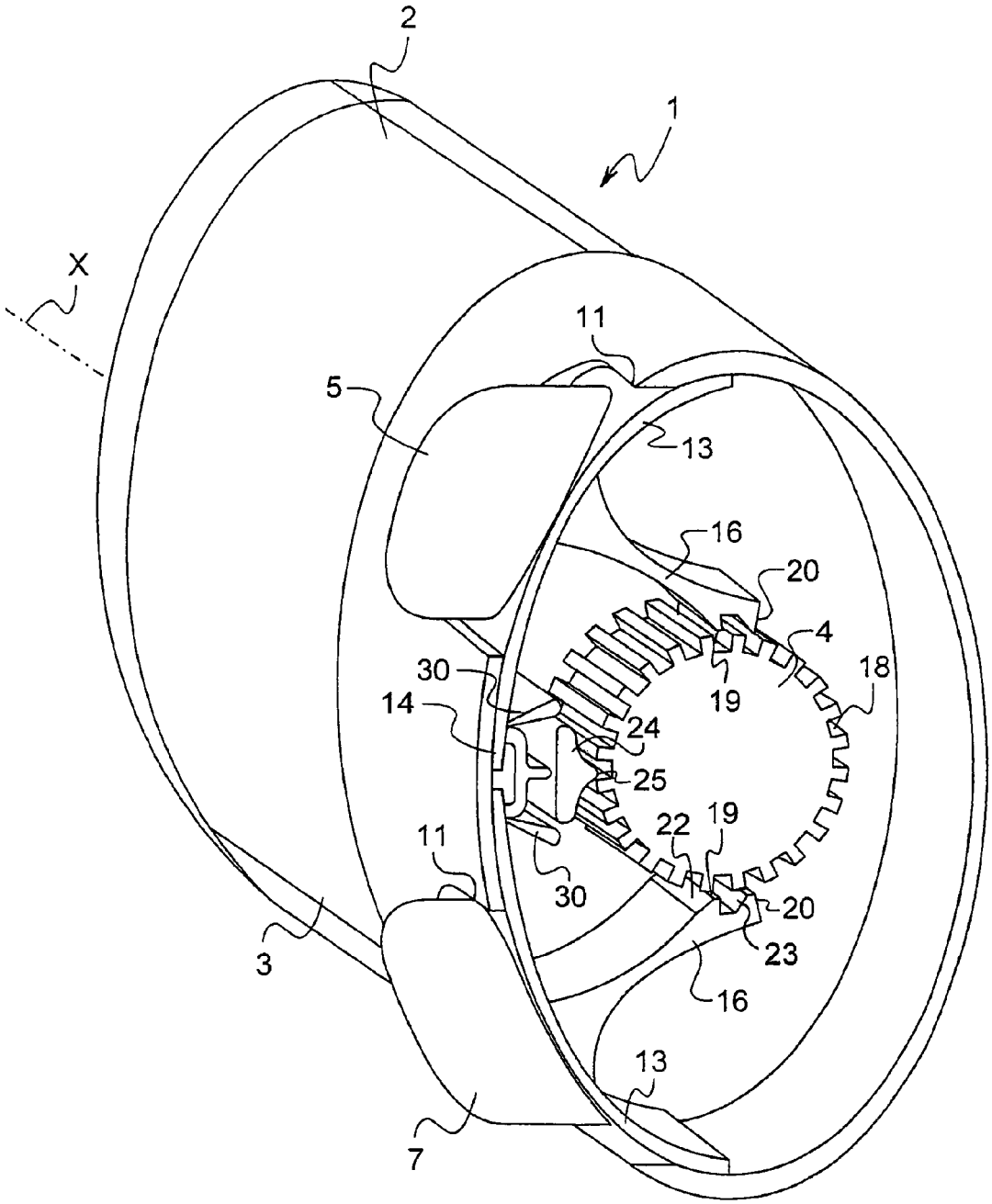
FIG. 1 is a fragmentary and diagrammatic view in perspective of an exemplary packaging and dispenser device.
Figure 2:
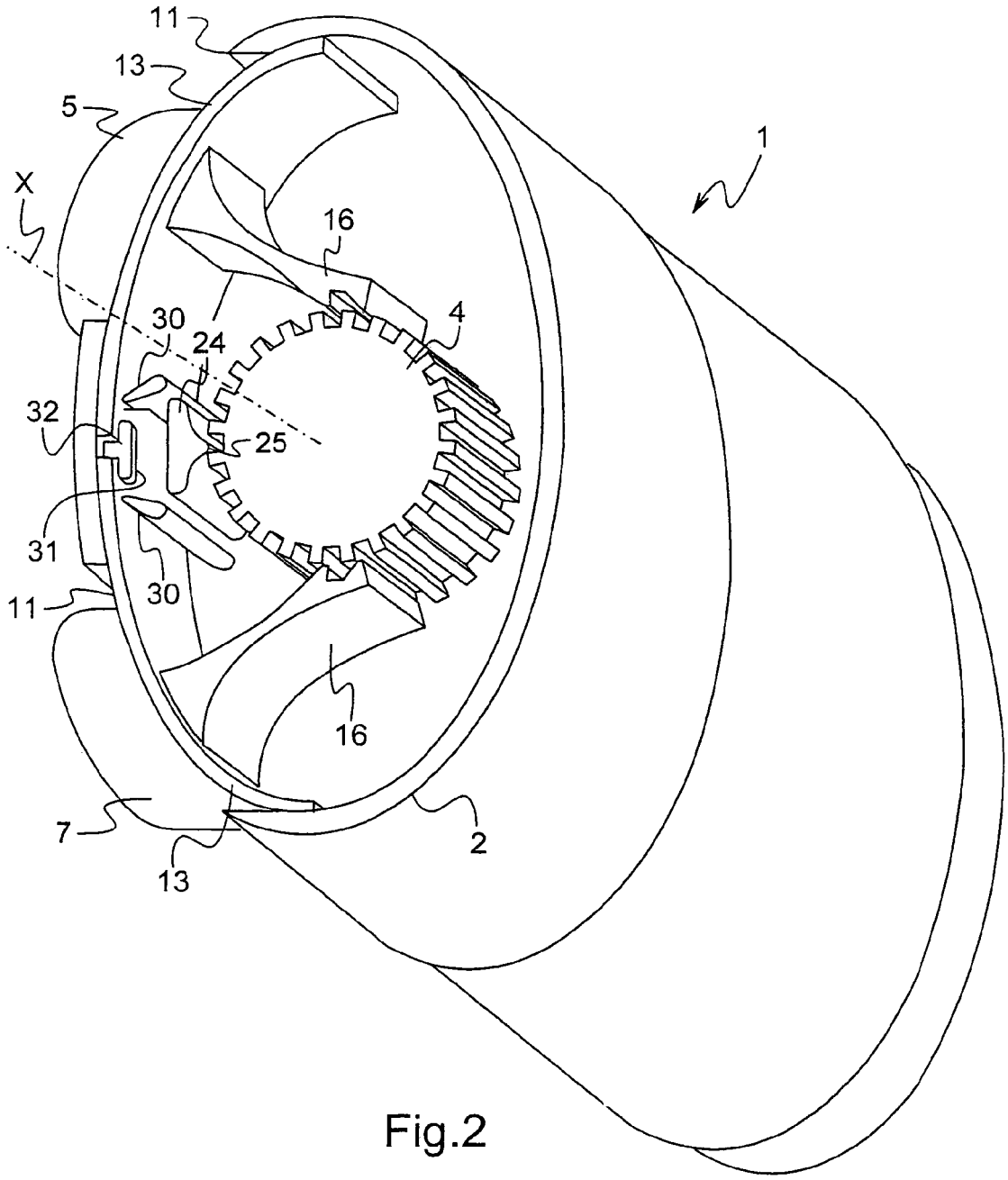
FIG. 2 is a view similar to FIG. 1, from another view point.
Figure 3:
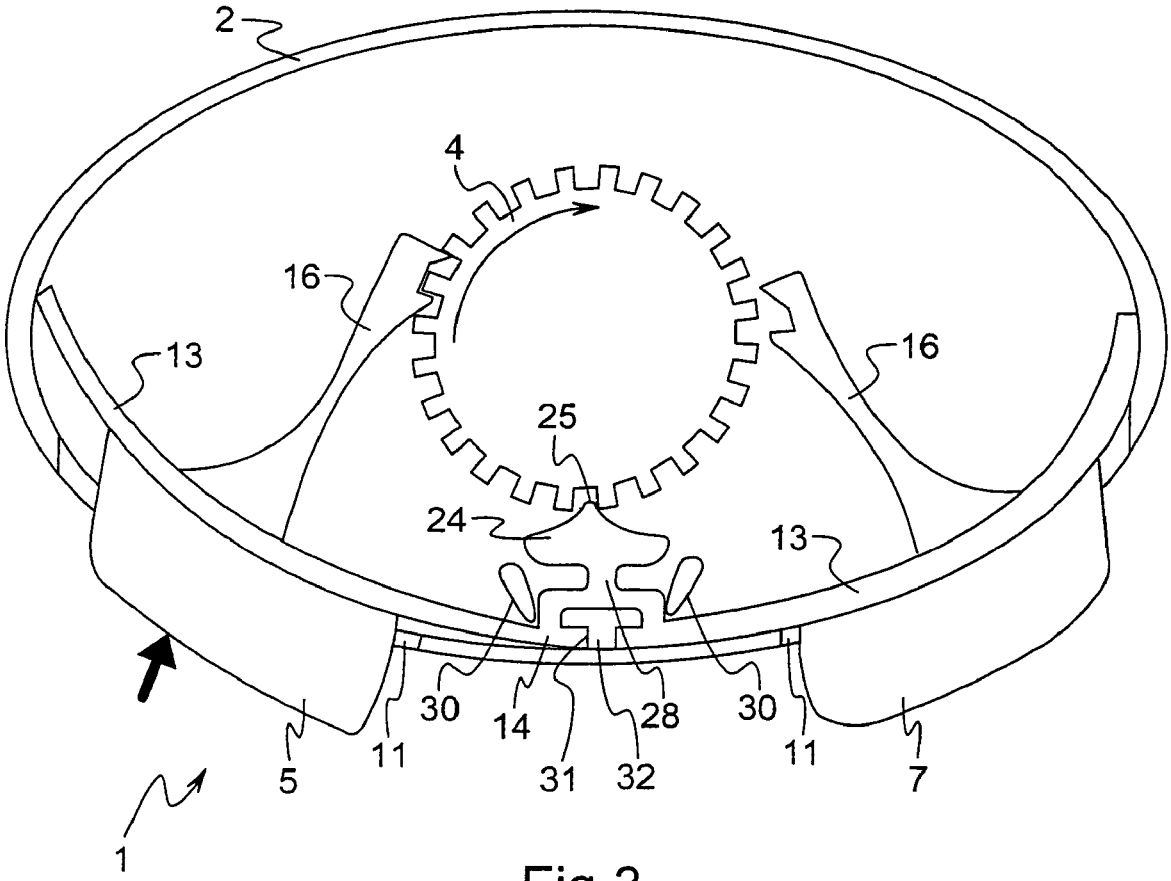
FIG. 3 is a view from below of the device in FIGS. 1 and 2, illustrating when the user presses on one of the pushbuttons.
Figure 4:
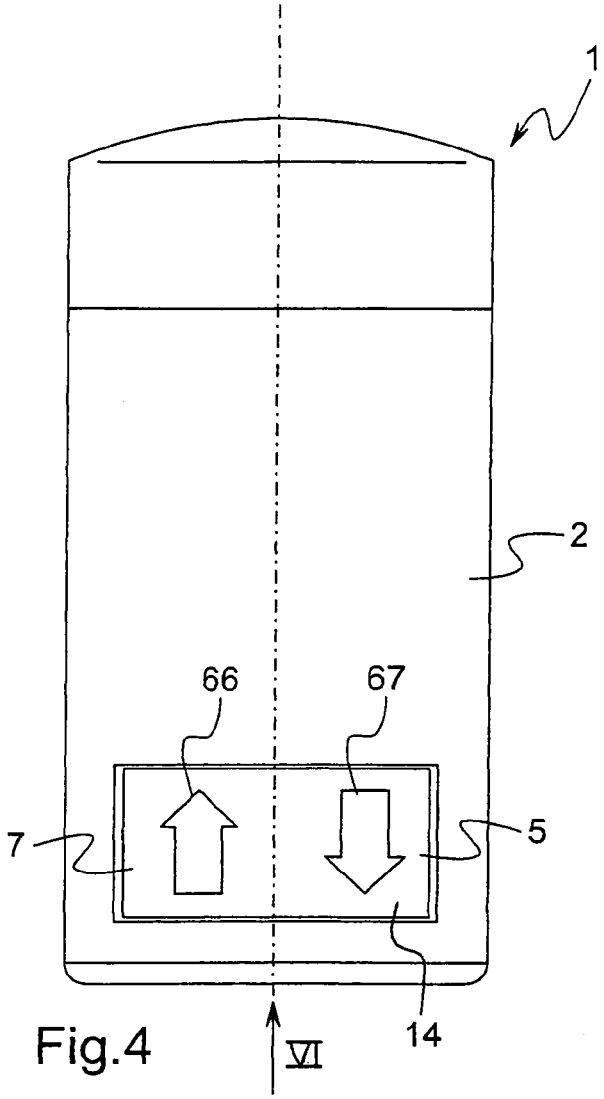
FIG. 4 is an elevation view of another exemplary device.
Figure 5:
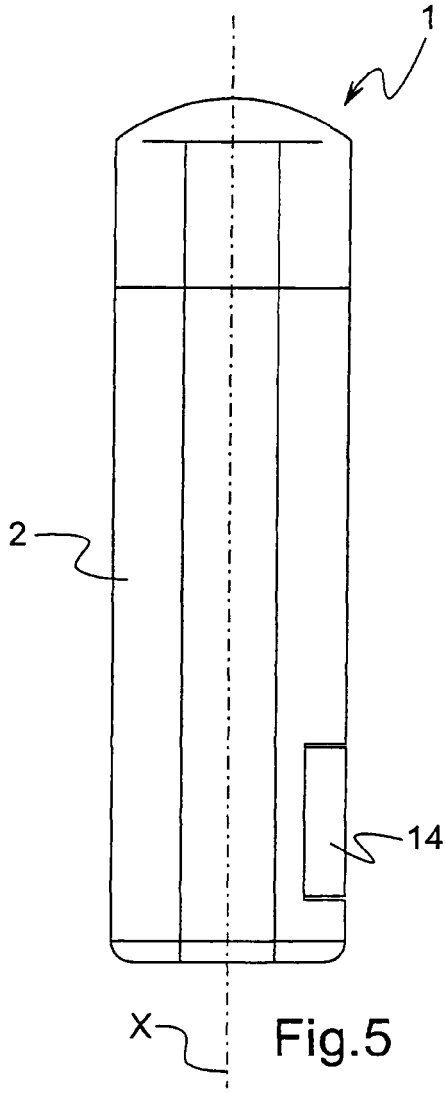
FIG. 5 is a side view of the device of FIG. 4.
Figure 6:
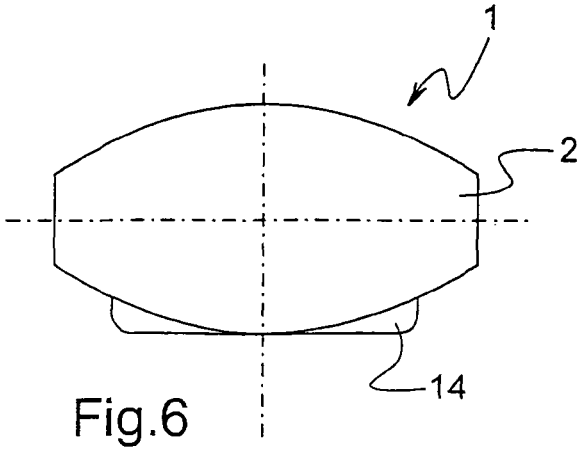
FIG. 6 is a plan view of the device of FIG. 4.

The exemplary packaging and dispenser device 1 illustrated in FIGS. 1 to 3 may comprises a casing 2 of longitudinal axis X, containing a composition to be dispensed, for example, a deodorant, which may be in a solid form or a fluid form.

The casing 2 may include a body including a cylindrical portion 3 including a generator line that is parallel to the axis X, and that sweeps around a closed curve that is oval.

Inside the casing 2, a dish or a piston 99 may be mounted to make it possible to displace the composition or to act thereon. The dish or piston, may be configured to slide in the cylindrical portion 3, and may be displaced by a screw that is mounted inside the casing 2 in such a manner as to maintain substantially a same axial position, but may turn about the axis X.

Turning the screw in one direction or the other may thus causes the piston or the dish to move up or down in the casing 2, and may make it possible to cause the composition to be extended from, or retracted into, the casing 2.

The screw may be secured to one end of a rotary member 4 that may be made integrally, i.e., monolithically, with the screw by molding a plastics material, and that may constitute the head thereof.

The device 1 may include an actuator mechanism comprising two pushbuttons 5 and 7 that enable the user to cause the rotary member 4 to turn in one direction or the other.

Each pushbutton 5 or 7 may be engaged in a corresponding opening 11 of the casing 2, and may be carried by an elastically-deformable blade 13 of a base portion 14 that is mounted in stationary manner inside the body of the casing 2. Each blade 13 may completely close the associated opening 11, thus preventing dirt from penetrating inside the casing 2, at least while at rest.

On a side remote from the associated pushbutton 5 or 7, each blade 13 may carry an arm 16 that may be configured, when the user presses on the pushbutton, to mesh with fluting 18 in the rotary member 4, the fluting 18 extending parallel to the axis X.

The two arms 16 may be substantially symmetrical to each other about a mid-plane of the device, that is substantially perpendicular to the long axis of the oval section of the casing 2. Also, the two arms 16 may slope toward each other.

Each arm 16 may include two teeth 19 and 20 that are configured to co-operate with the fluting 18 in such a manner as to turn the rotary member 4 when the user presses on the corresponding pushbutton. The two teeth 19 and 20 may also be configured to avoid any reverse movement via sloping flanks 22 and 23. The teeth 19 and 20 may disengage from the rotary member 4 when the user releases the corresponding pushbutton.

To promote such disengagement, the actuator system may include a brake shoe 24 that bears against the rotary member 4.

In exemplary embodiments, the brake shoe 24 may include a generally triangular cross-section, with a ridge 25 that is configured to be engaged in the fluting 18.

The brake shoe 24 may be connected to the base portion 14 via a thin region 28 that enables the brake shoe to pivot a little while the rotary member 4 is turning. The passage from one groove of the fluting 18 to another may be accompanied by emission of a click.

Two splines 30, which may be made integrally, i.e., monolithically, with the casing 2, may be provided on either side of the brake shoe 24, so as to limit an amplitude of the angular movement of the brake shoe 24.

The base portion may include a slideway 31 in which may be engaged a portion in relief 32 of the casing 2 that is T-shaped, for example. The base portion 14 may be mounted in the casing 2 by sliding along the axis X in exemplary embodiments.

When the user presses on one of the pushbuttons, the corresponding arm 16 may become engaged in the fluting 18, and may turn the rotary member 4 in the associated direction, as illustrated in FIG. 3. This turning may cause the composition to be dispensed, or, on the contrary, may retract the composition into the casing, depending on which pushbutton is selected. When the user releases the pushbutton, the pushbutton may be returned to the initial position thereof by the elasticity of the blade 13 that carries the pushbutton.

FIGS. 4 to 10 illustrate another exemplary device.

This device differs from the above-described device mainly by the fact that the base portion 14 is no longer mounted in a stationary manner on the casing 2, but may pivot about an axis Y that is parallel to the axis X, between two positions, each corresponding to turning the rotary member 4 in one direction.

Figure 8:
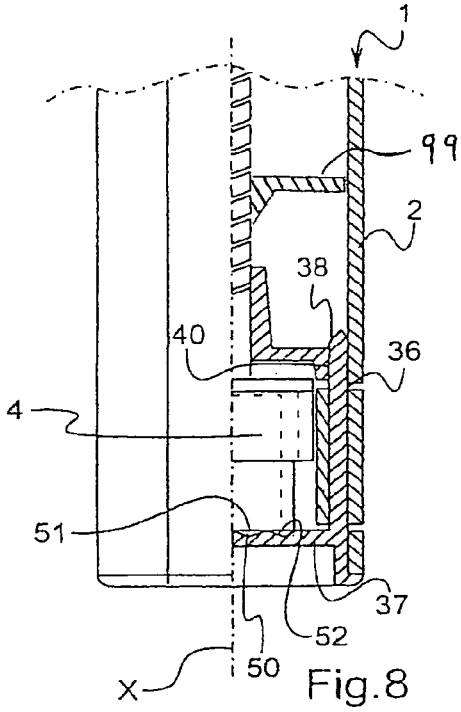
FIG. 8 is a fragmentary longitudinal cross-sectional view of the exemplary device shown in FIG. 7.
Figure 10:
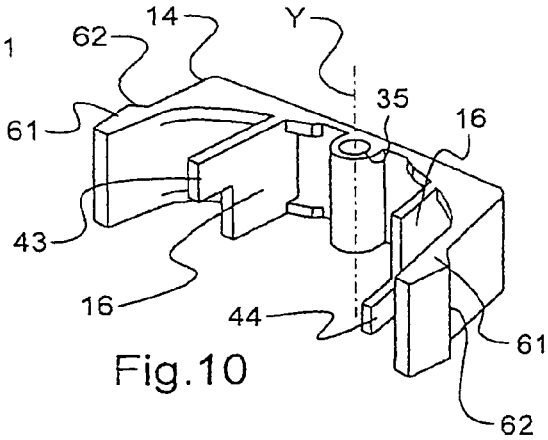
FIG. 10 is a diagrammatic view in perspective illustrating the base portion of the device of FIGS. 4 to 9, in isolation.

More particularly, as illustrated in FIGS. 8 and 10, the base portion 14 may include an opening 35 through which passes a pivot pin 36, which may be made integrally, i.e., monolithically, with a separate part 37 that defines a bottom of the casing 2. The pivot pin 36 may also include a top end 38 that is received in a housing 40 of the casing 2.

The base portion 14 may include two arms 16 that include extensions 43 and 44 that are configured to co-operate with two respective sets of teeth 46 and 47, which may be offset along the axis X of the rotary member 4. The sets of teeth 46 and 47 may comprise catches that are oriented in opposite directions. The extension 43 may engage the catches of the set of teeth 46 when the user presses on the portion, constituting the pushbutton 7, that is situated on the left of the axis Y in FIG. 9, while the extension 44 may engage the catches of the set of teeth 47 when the user presses on the portion, constituting the pushbutton 5, that is situated on the right of the axis Y in FIG. 9. The catches of the sets of teeth 46 and 47 may include sloping faces 48, making it possible to return the corresponding arm 16 to its respective initial position without turning the rotary member 4.

As illustrated, the separate part 37 may advantageously include a brake surface 50 that comes to bear axially against the end face 51 of the rotary member 4, so as to prevent the rotary member from moving during the return movement of the arm 16 used to turn the rotary member.

In exemplary embodiments, the brake surface 50 may include portions in relief 52 in such a manner as to generate more friction.

Figure 7:
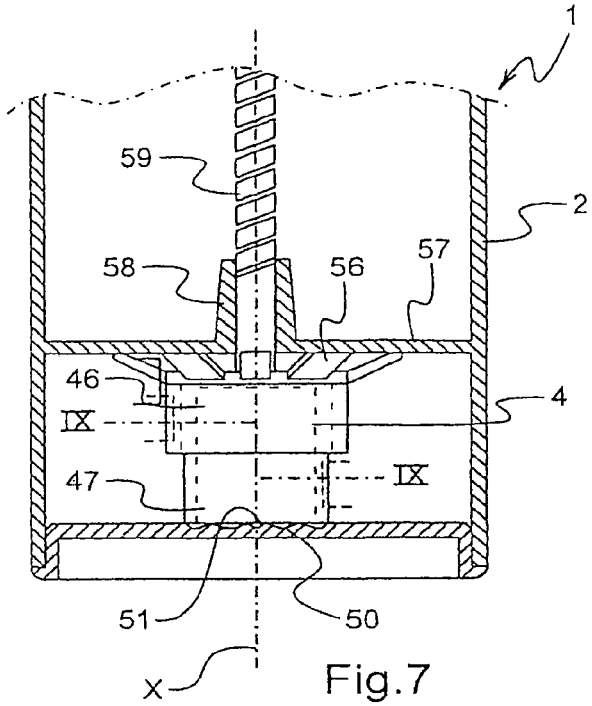
FIG. 7 is a fragmentary and diagrammatic longitudinal cross-sectional view of the device of FIGS. 4 to 6.

An end face 51 of the rotary member 4 may be held pressed against the brake surface 50 by a resilient return member, which, in exemplary embodiments, may be in the form of a plurality of elastically-deformable fins 56 that are made integrally, i.e., monolithically, with the rotary member 4 by molding, and that bear against the bottom of a transverse wall 57 of the casing 2, as illustrated in FIG. 7.

The transverse wall 57 may support a guide 58 for a screw 59 to which the rotary member 4 may be secured, the screw being made integrally, i.e., monolithically, with the rotary member 4 by molding a plastics material, for example.

The base portion 14 may include wings 61 at its sides, each wing being provided with a tooth 62 making it possible to limit a degree to which the base portion 14 pivots about the axis Y by coming into abutment against the wall of the casing 2.

Figure 9:
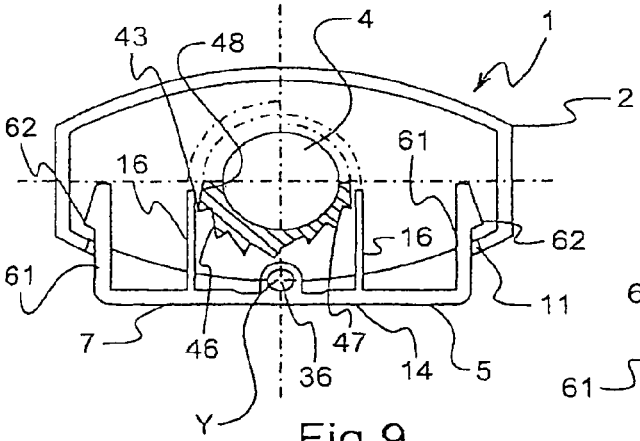
FIG. 9 is a fragmentary cross-sectional view taken along IX-IX in FIG. 7.

In exemplary embodiments, the arms 16 may extend parallel to each other, and parallel to a plane containing the axes X and Y in FIG. 9.

For example, indicators 66 and 67 may be carried on the base portion 14 at locations where the user should press to cause the rotary member 4 to turn in one direction or the other. For example, the indicators 66 or 67 may be made integrally, i.e., monolithically, with the base portion 14 as respective portions in relief while the base portion is being molded, and/or may be made by printing or attaching pieces of decoration.

The invention is not limited to the exemplary embodiments described above.

For example, the base portion 14 of the exemplary embodiment in FIGS. 4 to 10 may be provided with the arms 16 of the exemplary embodiment in FIGS. 1 to 3, adapting the shape of the arms 16, if necessary or desired.

The resilient fins 56 may be replaced by other resilient return means, for example, a spring-forming washer.

The brake shoe 24 may be replaced by the brake surface 50.

The expression "comprising a" should be understood as being synonymous with "comprising at least one", unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and dispenser device for a composition, the device comprising:

a casing containing a reserve of composition;

a composition-dispenser mechanism comprising a rotary member, which, when turned in a first direction, is accompanied by the composition being dispensed; and an actuator system configured to act on the rotary member of the composition dispenser mechanism, the actuator system comprising:

a first pushbutton configured to turn the rotary member in the first direction, rotation of the rotary member resulting from actuation of the first pushbutton occurring only in the first direction; and a second pushbutton configured to turn the rotary member in a second direction, opposite to the first direction, rotation of the rotary member resulting from actuation of the second pushbutton occurring only in the second direction.

2. A device according to claim 1, wherein at least part of the first and second pushbuttons is monolithic with a base portion of the actuator system.

3. A device according to claim 2, wherein at least one of the base portion and the casing includes a slideway, and the other of the base portion and the casing includes a corresponding portion in relief engaged in the slideway.

4. A device according to claim 2, wherein the first and second pushbuttons of the actuator system are hinged about a common pivot axis, and wherein the casing includes a separate part including a pivot pin on which the base portion is hinged.

5. A device according to claim 4, wherein the separate part includes a brake surface that comes into contact with the rotary member.

6. A device according to claim 5, wherein the brake surface comes to bear axially against an end face of the rotary member.

7. A device according to claim 5, wherein the device includes a resilient return member that urges the rotary member to bear against the brake surface.

8. A device according to claim 7, wherein the resilient return member comprises elastically-deformable fins.

9. A device according to claim 8, wherein the elastically-deformable fins of the resilient return member are monolithic with the rotary member and bear axially against a transverse wall of the casing.

10. A device according to claim 9, wherein the transverse wall guides a screw that is secured to the rotary member.

11. A device according to claim 2, wherein the base portion comprises indicators that inform a user about a location of bearing zones of the first and second pushbuttons, and about a direction in which at least one of a piston and a dish is displaced inside the casing.

12. A device according to claim 2, wherein the base portion is mounted in a stationary manner on the casing.

13. A device according to claim 12, wherein the base portion includes two elastically-deformable blades, each associated with a respective one of the first and second pushbuttons.

14. A device according to claim 13, wherein the base portion includes arms, each configured to act on the rotary member when a user presses on a corresponding one of the first and second pushbuttons, and wherein each arm is carried by a corresponding one of the two elastically-deformable blades.

15. A device according to claim 13, wherein the casing includes two openings corresponding to the first and second pushbuttons, and wherein the elastically-deformable blades of the base portion are pressed against edges of the openings when the device is at rest.

16. A device according to claim 2, wherein the base portion is hinged on the casing.

17. A device according to claim 16, wherein the base portion includes abutments configured to limit a degree to which the base portion pivots in either direction by coming into abutment against a wall of the casing.

18. A device according to claim 2, wherein the base portion includes arms, each configured to act on the rotary member when a user presses on a corresponding one of the first and second pushbuttons.

19. A device according to claim 18, wherein the arms slope toward each other.

20. A device according to claim 18, wherein the arms are substantially symmetrical to each other about a mid-plane of the device.

21. A device according to claim 18, wherein each arm includes at least a first portion in relief that may be configured to co-operate with a second portion in relief of the rotary member when the user presses on the corresponding pushbutton, so as to turn the rotary member.

22. A device according to claim 21, wherein the first portion in relief is configured to mesh with the rotary member during a relative movement thereof in accordance with the corresponding pushbutton being pressed in, and to disengage from the rotary member during a relative movement in an opposite direction.

23. A device according to claim 1, wherein the rotary member includes fluting.

24. A device according to claim 1, wherein the actuator system includes a brake configured to oppose rotation of the rotary member.

25. A device according to claim 24, wherein the brake comprises a brake shoe that comes into contact with the rotary member.

26. A device according to claim 25, wherein at least part of the first and second pushbuttons is monolithic with a base portion of the actuator system, and wherein the brake shoe is monolithic with the base portion of the actuator system.

27. A device according to claim 26, wherein the brake shoe includes a thin zone that imparts flexibility thereto.

28. A device according to claim 25, wherein the rotary member includes fluting, and wherein the brake shoe comprises a ridge that is disposed in such a manner as to become engaged in one of a plurality of grooves of the fluting of the rotary member.

29. A device according to claim 28, wherein the device is configured so that each time the ridge passes from one groove to another groove, a click sound is emitted.

30. A device according to claim 25, wherein the casing comprises two splines and wherein the brake shoe is disposed between the two splines.

31. A device according to claim 1, wherein the casing includes two openings corresponding to the first and second pushbuttons.

32. A device according to claim 1, wherein the first and second pushbuttons of the actuator system are hinged about a common pivot axis.

33. A device according to claim 1, wherein the rotary member includes two sets of teeth that are axially-offset, and that comprise oppositely-directed catches.

34. A device according to claim 33, wherein the actuator system is configured to act on a respective one of the two sets of teeth when a user pivots the actuator system in a corresponding direction.

35. A device according to claim 33, wherein the actuator system includes two arms each being configured to act on a respective one of the sets of teeth.

36. A device according to claim 35, wherein at least part of the first and second pushbuttons is monolithic with a base portion of the actuator system, and wherein the two arms are monolithic with the base portion.

37. A device according to claim 1, wherein the actuator system is configured so that pressing on one of the first and second pushbuttons causes the rotary member to pivot through a stroke that is substantially identical to a pivot stroke that results from pressing on the other of the first and second pushbutton, when pressed in to a same degree.

38. A device according to claim 1, wherein the composition dispenser mechanism includes a screw that meshes with at least one of a piston and a dish, the piston or the dish being movable in translation inside the casing.

39. A device according to claim 1, wherein the reserve of composition comprises a solid cake of composition.

40. A device according to claim 1, wherein the reserve of composition comprises at least one of a gel, a paste, and a cream.

41. A device according to claim 1, wherein the reserve of composition comprises at least one of a cosmetic and a skin care product.

* * * * *